United States Patent [19]

Lundgren

[11] 4,170,885

[45] Oct. 16, 1979

[54] SLIDING DOOR LOCK

[76] Inventor: Calvin Q. Lundgren, Rte. 4, Box 620 G, Chico, Calif. 95926

[21] Appl. No.: 907,871

[22] Filed: May 22, 1978

Related U.S. Application Data

[63] Continuation of Ser. No. 697,714, Jun. 21, 1976, abandoned.

[51] Int. Cl.[2] ..... E05B 65/08; E05C 13/00

[52] U.S. Cl. ..... 70/97; 49/449; 70/99; 292/DIG. 46

[58] Field of Search ..... 70/26, 32, 33, 34, 39, 70/77, 78, 79, 80, 89, 91, 95, 96, 97, 98, 99, 100, 56, 57, 58, 117, 128; 292/57, DIG. 46, DIG. 47; 49/449, 450

[56] References Cited

U.S. PATENT DOCUMENTS

| | | | |
|---|---|---|---|
| 153,673 | 8/1974 | Fox | 70/57 |
| 1,377,748 | 5/1921 | Christenson | 292/57 X |
| 1,597,837 | 8/1926 | Staley | 292/57 |
| 1,864,883 | 6/1932 | Anderson | 70/95 X |
| 2,050,695 | 8/1936 | Fetyk | 70/95 |
| 2,050,696 | 8/1936 | Schoorel | 70/95 |
| 2,473,285 | 6/1949 | Koester | 70/96 |
| 2,677,261 | 5/1954 | Jacobi | 70/32 X |
| 2,799,153 | 7/1957 | Petersen | 70/100 |
| 2,831,335 | 4/1958 | Kidd et al. | 70/58 |
| 2,983,133 | 5/1961 | Hruby | 70/39 X |
| 3,094,861 | 6/1963 | Sayles | 292/DIG. 46 |
| 3,423,968 | 1/1969 | Foote | 70/95 X |
| 3,768,847 | 10/1973 | Buck et al. | 292/DIG. 46 X |
| 3,945,228 | 3/1976 | Voegeli | 70/39 X |
| 3,973,420 | 8/1976 | Brady et al. | 70/78 |

FOREIGN PATENT DOCUMENTS

| | | | |
|---|---|---|---|
| 1500858 | 6/1969 | Fed. Rep. of Germany | 292/57 |
| 113058 | 2/1918 | United Kingdom | 292/57 X |

*Primary Examiner*—Thomas J. Holko

*Attorney, Agent, or Firm*—Flehr, Hohbach, Test

[57] ABSTRACT

Disclosed is a locking device for locking bypassing sliding doors having support frames positioned in close proximity when the doors are translated to a position for locking. A locking arm is carried by one of the support frames and locking means are carried by the other support frame and are slidably engagable with the locking arm when the supports are in close proximity, thereby locking the doors.

24 Claims, 16 Drawing Figures

SLIDING DOOR LOCK

This is a continuation of application Ser. No. 697,714 filed June 21, 1976 now abandoned.

BACKGROUND OF THE INVENTION

The present invention relates to locking devices for locking bypassing sliding members as, for example, in a sliding glass door.

Sliding glass doors have become very popular today, and there is, of course, a need for locking devices which are secure and strong to provide adequate protection for those many places that utilize such doors, such as homes, apartments and offices.

Some prior art locking devices have provided latches at the handle of one of the doors, which will engage a vertical enclosure end frame of the sliding glass door when the door is in a closed position.

Another prior art device provides a latch at the base of the door itself, which engages the base frame of the other sliding glass door when locked.

In a third example of the prior art, a locking device is glued to the glass itself at the center frame of each sliding door.

By their very nature, the above-described prior art devices are not particularly strong so that unauthorized entry can be obtained through the doors with a minimal amount of force.

Another problem with prior art devices is that the doors can be locked and unlocked from only one side. Those persons wishing to obtain access into a home, apartment or office having such sliding doors must either obtain access by another entrance or have someone unlock the door for them from the other side.

Another problem with prior art devices is that there is often a small amount of play between the center frames of the sliding glass doors. This play has a disadvantage of making an unauthorized entry even easier. Furthermore, for those doors that are provided with airtight seals at the center frames against, for example, outside weather conditions or noise, the play reduces the effectiveness of that seal.

Thus, there is a need for a sliding door lock that is secure and strong, while aiding to maintain an airtight seal and yet can be locked and unlocked from either side. Because of the many various shapes and sizes of present day sliding doors, there is a need for a sliding door lock that has the above mentioned qualities yet is adaptable to a buyer's particular wishes or needs.

SUMMARY OF THE INVENTION

The present invention relates to a locking device for locking bypassing sliding doors where at least one of the doors translates parallel to a plane of relative translation between the doors where the first door includes a first support frame, where the second door includes a second support frame, and where the supports are positioned in close proximity when the doors are translated to a position for locking.

In one embodiment of the invention, the locking device includes a locking arm carried by the first support frame, locking means carried by the second support frame and slidably engageable with the locking arm for locking the locking arm and the locking means when the supports are in close proximity, thereby locking the doors. The locking means includes means for unlocking the locking element and locking means.

In another embodiment, the locking element includes arm means having notches thereon and the locking means includes a lock bolt for engaging said arm means whereby said notches engage said lock bolt to lock said members when said supports are in close proximity.

In another embodiment of the present invention, the arm means includes means for rotating the arm means whereby said arm means may be released from the locking means.

In still another embodiment, the locking element includes supporting means for enabling the first supporting member to carry the locking element.

In still another embodiment of the present invention, the locking means includes a locking cylinder, a first gear carried coaxially by the locking cylinder, a second gear disposed adjacent to the first gear and carried coaxially by an elongated arm, the elongated arm engagable with a lock bolt whereby rotation of the lock cylinder will engage or disengage the lock bolt from the locking element dependent upon the direction of rotation of the lock cylinder.

In accordance with the above summary, the present invention achieves the objective of providing an improved locking device for locking bypassing sliding doors.

Additional objects and features of the invention will appear from the following description in which the preferred embodiments of the invention have been set forth in detail in conjunction with the drawings.

DETAILED DESCRIPTION OF THE DRAWINGS

Figure 1:
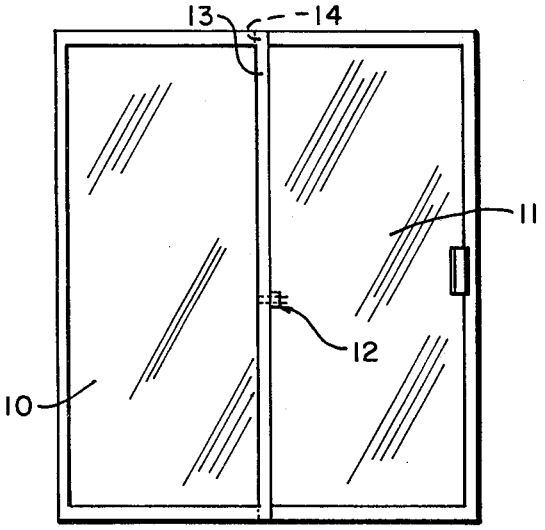
FIG. 1 depicts a frontal view of bypassing sliding doors in a closed position with the sliding door lock mounted on the center frames.

Referring to FIG. 1, there is shown bypassing sliding glass doors 10, 11 on which the locking device 12 is mounted on the center frames 13, 14 of the bypassing doors 10, 11.

Figure 2:
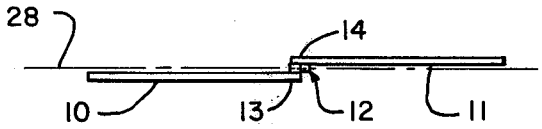
FIG. 2 depicts a top view of the sliding door lock mounted on the center frames of the bypassing doors.

FIG. 2 shows a top view of FIG. 1 with the locking device 12 mounted on the center frames 13, 14. Bypassing doors 10, 11 are shown in a position for locking, with the doors 10, 11 parallel to a plane 28 of relative translation between the doors. Center frames 13, 14 are shown in close proximity when the doors 10, 11 are in a position for locking.

Figure 3:
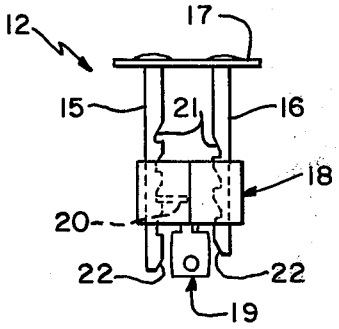
FIG. 3 depicts a side cross-sectional view of one embodiment of the sliding door lock.

In FIG. 3, the locking device 12 is shown with arms 15, 16 secured to a flat supporting plate 17 and with padlock 18 engaging the arms 15, 16. The flat plate 17 may be secured to arms 15, 16 by such means as welding or riveting. The padlock 18 is released from engaging the arms 15, 16 by the key 19 (which may be removable or non-removable). A lock bolt 20 within the padlock 18 engages one of the offset notches 21 along the arms 15, 16. The offset notches 21 allow the padlock 18 to be adjusted as necessary along the length of the arms 15, 16. Actuation of the key 19 disengages the lock bolt 20 from one of the notches 21. The details of the action of lock bolt 20 within padlock 18 are well known, but will be briefly described subsequently. The arms 15, 16 are shown with beveled edges 22 to facilitate easier access into the padlock 18.

Figure 4:
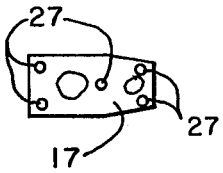
FIG. 4 depicts a top view of FIG. 3.

FIG. 4 shows a top view of the locking device 12 in which the supporting plate 17 has mounting holes 27 therein for mounting screws to secure the plate 17 to one of the center frames.

Figure 5:
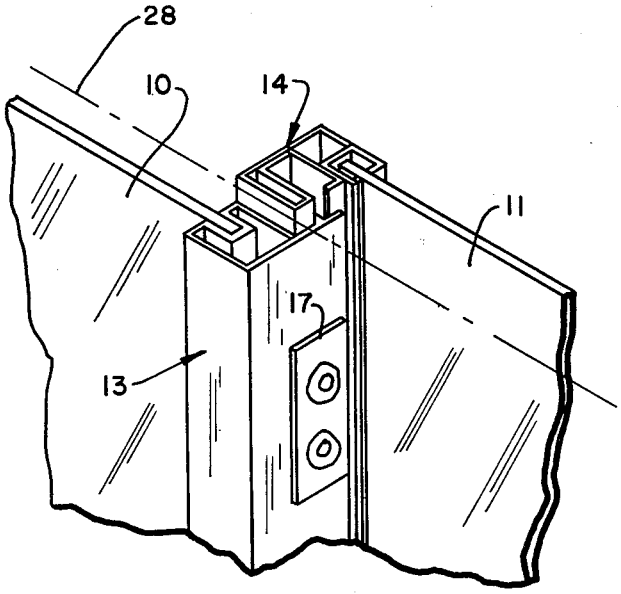
FIG. 5 depicts a perspective view of a locking element mounted on one of the center frames of the sliding door.

In FIG. 5, bypassing doors 10, 11 are in a position for locking, with doors 10, 11 parallel to a plane 28 of translation between the doors. Center frames 13, 14 are positioned in close proximity when doors 10, 11 are in a position for locking. Flat supporting plate 17 is shown carried by center frame 13 of sliding door 10. Allignable holes could be drilled through both of the center frames 13, 14 to accommodate the arms 15, 16 of the locking device 12. However, the arms 15, 16 could be mounted on the interior side of center frame 13 to obviate the need for drilling holes.

Figure 6:
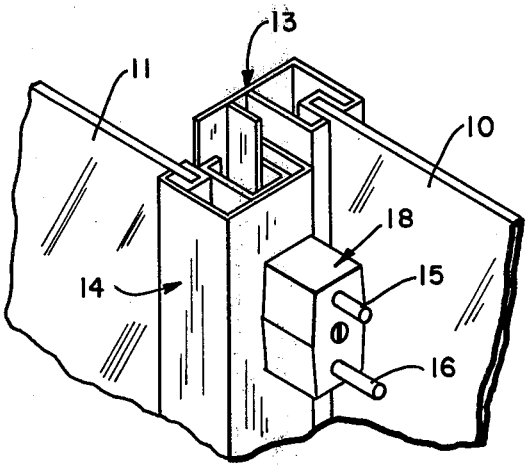
FIG. 6 depicts a perspective view of locking means engaging the locking element on the center frame of the other sliding door.

In FIG. 6 the padlock 18 is shown engaging the arms 15, 16 so that the center frames 13, 14 are secured to each other and the doors 10, 11 cannot be opened unless the locking device is released.

It can be seen from FIGS. 5 and 6 that padlock 18 will engage arms 15, 16 when center frames 13, 14 are in close proximity to each other. Furthermore, for those doors that are provided with airtight seals such as, for example, weather stripping, the use of the present invention will aid in making a weather tight seal when the doors are in a closed and locked position.

The supporting plate 17 may be permanently or temporarily mounted to the center frame 13. Similarly, the padlock 18 may be permanently or temporarily mounted to center frame 14. The padlock 18 could be secured to the interior side of the center frame 14, provided that center frame would be large enough for that purpose. This would obviate the need for drilling holes through that center frame and in addition would serve to hide the locking device from view.

Figure 7:
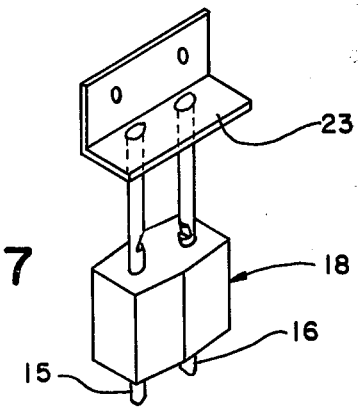
FIG. 7 depicts a perspective view of another embodiment of the sliding door lock.

FIG. 7 shows another embodiment of the present invention in which the arms 15, 16 of the locking device 12 are mounted on a bracket 23, to be utilized for those situations where the clearance between the panes of a sliding glass door is minimal. The bracket 23 can be mounted on one of the center frames 13, 14 in a manner similar to that previously described.

Figure 8:
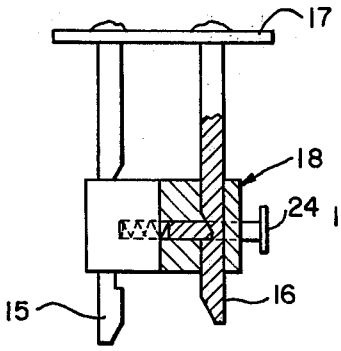
FIGS. 8, 9A and 9B depict cross-sectional side views of still further embodiments of the sliding door lock.

FIG. 8 shows a further embodiment of the present invention in which the padlock 18 may be released from engaging the arms 15, 16 by actuating a spring loaded plunger 24.

Figure 9B:
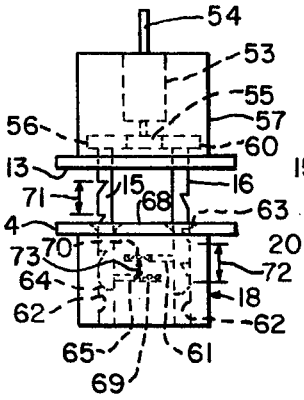
Figure 9A:
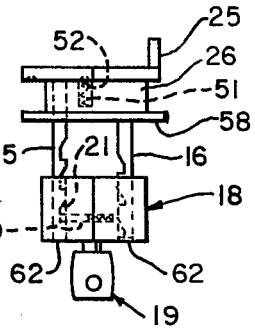

In FIG. 9A another embodiment of the present invention is shown, in which arm 15 is rotated by rotating handle 25, which is carried by supporting structure 26 and support plate 58. A spring actuated ball bearing 51, in supporting structure 26, is shown engaging recess 52 in handle 25 to maintain arm 15 in an engaged position as shown. Sufficient rotation of arm 15 (say 90°–180°) will disengage notch 21 from lock bolt 20 provided there is sufficient pressure to overcome the force of bearing 51. The arms 15, 16 may then be withdrawn from padlock 18 thus providing a locking device that can be opened from either side of the sliding doors. It is possible to replace the rotating handle 25 with releasing means such as key actuation. Supporting structure 26 on supporting plate 58 and padlock 18 may be temporarily or permanently mounted to center frames 13 and 14 as previously mentioned in connection with FIG. 6. In order to prevent external rotation of arm 15 as in FIG. 9A, arm 15 could be cut to size by the installer of the locking device to insure that arms 15, 16 do not extend externally through padlock 18. Shafts 62 are then covered or closed to prevent outside access to arms 15, 16. The plunger actuated padlock shown in FIG. 8 may be substituted for the key actuated padlock shown in FIG. 9A.

Figure 9C:
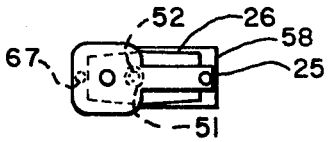
FIG. 9C depicts a top view of FIG. 9A.

Referring to FIG. 9C, a top view of handle 25 and supporting structure 26 is shown in which spring actuated ball bearing 51 in structure 26 engages another recess 67 in handle 25 to maintain arm 15 in a disengaged position relative to bolt 20. Handle 25 has rounded edges to allow room for rotation between the doors. Another spring actuated ball bearing (not shown) could be included in structure 26 to engage recess 67.

In FIG. 9B, padlock 18 is shown carried by center frame 14. Supporting structure 57 is carried by center frame 13. A lock cylinder 53 carries coaxially first gear 55 which in turn engages gears 56 and 60. Arm 15 coaxially carries gear 56 and arm 16 coaxially carries gear 60. Turning of key 54 will rotate lock cylinder 53 and gear 55, which action will rotate gears 56 and 60. Springs 69 and 70 maintain pressure upon lock bolts 65 and 61 to engage notches 21. Arms 15 and 16 are rotated and, as shown in FIG. 9B, disengaged from lock bolts 65 and 61, respectively, and partially disengaged from padlock 18. Padlock 18 has shafts 62 therein to receive arms 15, 16. The face 68 of support member 14 has chamfers 63 formed therein so that the cross-sectional area of the shafts 61 at the face 68 are large enough to correct any misallignment of arms 15, 16 and to facilitate easier access of arms 15, 16 for proper seating of the locking device. Arms 15, 16 have bevels 64 formed on the ends in order to further facilitate access into the shafts 61. Shims may be added as necessary to allow for further adjustment of padlock 18 along arms 15, 16.

The notches 21 along arm 15 are shown spaced by a distance 71. Similarly, the notches along arm 16 are shown spaced by a distance 72 and bolts 61, 65 are spaced by a distance 73. It can be seen that the distances 71, 72 and 73 can be adjusted accordingly to provide finer gradation or adjustment of padlock 18 along arms 15, 16.

In FIG. 9B, it is possible for cylinder 53 to be carried by structure 57 transverse to the plane of translation of one of the doors. Cylinder 53 could coaxially carry a worm element to engage gear wheels 56 and 60. This would make unlocking the doors externally easier, since the cylinder could then be actuated externally from the front rather than the side of the doors.

Figure 10:
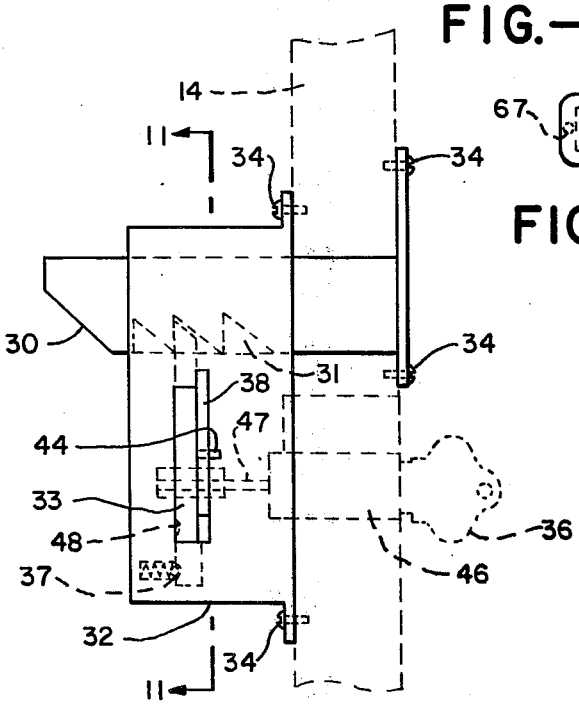
FIG. 10 depicts a front cross-sectional view of still another embodiment of the invention carried by the center frames of the sliding doors.
Figure 11:
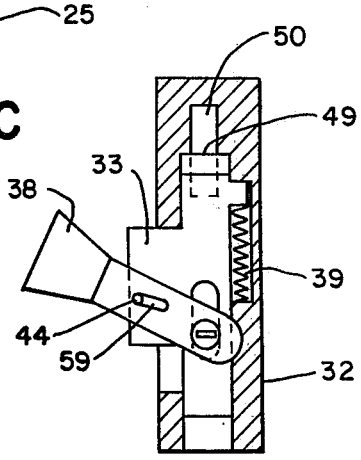
FIG. 11 depicts a side cross-sectional view of locking means shown in FIG. 10 taken along line 11—11.

In FIGS. 10 and 11 there is shown still further embodiments of the present invention. In FIG. 10 a bar stock 30 is shown carried on one of the center posts of the sliding doors. The bar stock 30 includes notches 31 thereon and is engagable with a lock mechanism 32 which is carried by the center frame of the other sliding door. The bar stock 30 and the lock mechanism 32 are shown carried by the center frames by mounting screws 34, but could be carried in any desired manner.

In FIG. 10, the locking device may be locked or unlocked by turning of key 36, which in turn will rotate lock cylinder 46, which when sufficiently turned (e.g. one-half turn) engages elongated arm 47 by means of a lazy cam operation, which is well known in the art. Further turning of key 36 then rotates engaged arm 47. Arm 47 engages handle 38 which engages with pin 44 through slot 59. Pin 44 is carried by lock bolt 33. Rotating arm 47 will, dependent upon direction of rotation of key 36, raise or lower lock bolt 33. Lock bolt 33 when raised will engage notch 31 of the bar stock 30. A spring actuated ball bearing 37 is shown in FIG. 10 for engaging recess 48 in lock bolt 33 for maintaining the lock bolt 33 in lowered or a unlocked position. Actuation of key 36 will provide sufficient force in overcoming the frictional pressure of bearing 37 in order to raise bolt 33 to engage notch 31.

Referring to FIGS. 10 and 11, the handle 38 in FIG. 11 shows a side view of the embodiment taken along line 11—11 for disengaging the lock bolt 33 from the bar stock 30. Bar stock 30 (see FIG. 10) engages slot 50, and beveled portion 49 of bolt 33 engages notch 31 to provide locking of the sliding doors. Applying downward pressure on the handle 38 upon pin 44 will lower the lock bolt 33 to provide disengagement of beveled portion 49 from notch 31. A compressible spring 39 provides for return of the lock bolt 33 to its normal position when the handle 38 is released, provided the ball bearing 37 is not engaged with any portion of recess 48.

In FIG. 10, the locking mechanism 32 could be installed without need of lock cylinder 46, if it is desired that the locking device only be unlocked from one side.

In FIG. 10, handle 38 could be placed parallel to the plane of one of the doors where, for example, a sliding glass door has next to it a screen door, and the space between them is small.

Figure 12:
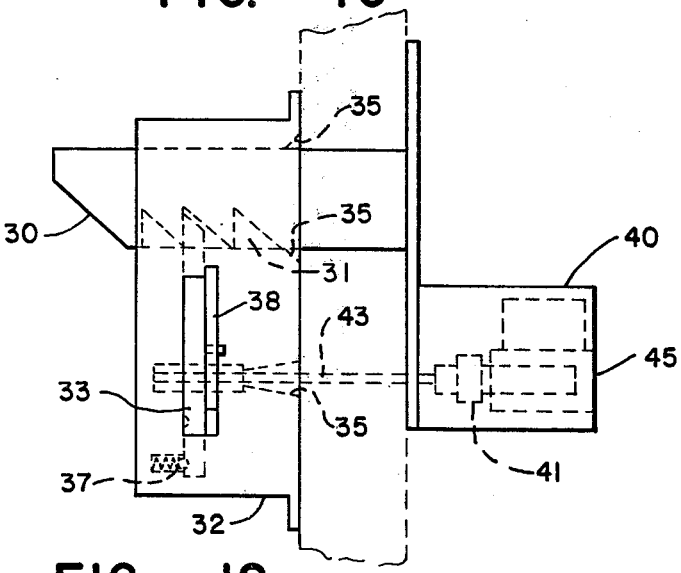
FIG. 12 depicts a front cross-sectional view of a still further embodiment mounted on the center frames of the sliding door.
Figure 13:
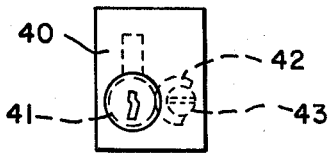
FIGS. 13 and 14 depict side and top cross-sectional views of the locking means of FIG. 12.
Figure 14:
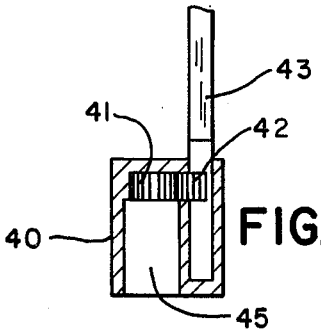

FIGS. 12, 13 and 14 show a still further embodiment of the present invention for those situations where the center frames are too small to accommodate a key cylinder. One of the center frames carries bar stock 30 having notches 31 thereon. The other center frame carries locking mechanism 40, including a locking cylinder 45 carrying coaxially gear 41, which engages gear 42. Gear 42 is carried coaxially by elongated arm 43. Arm 43 is engaging handle 38 when the center frames are in close proximity for locking. Turning of the locking cylinder 45, such as by a key, will turn gear 41, which engages and rotates gear 42. The rotation of gear 42 rotates arm 43 which raises or lowers the handle 38 which, as in the FIG. 10 embodiment, raises or lowers bolt 33, to engage or disengage from the bar stock 30, dependent upon the direction of rotation.

It can be seen that with the locking arm carried by one of the center frames in the manner as described above, there is an additional safety feature in that the locking arm is carried by a center frame and extends between the bypassing doors. Any persons passing through open bypassing doors with the present sliding door lock carried by the center frames cannot brush against the arm because it extends in a direction away from the open position.

While the invention has been particularly shown and described with reference to preferred embodiments thereof it will be understood in the art that various changes in form and details may be made therein without departing from the spirit and scope of the invention.

What is claimed is:

1. A locking device for locking sliding doors having bypassed first and second members where at least one of said members translates parallel to a plane of relative translation between said members, where said first member includes a first support, said second member includes a second support, and where said supports are positioned in close proximity when said members are translated to a position for locking, comprising:

a locking element carried on said first support parallel to said plane of relative translation, locking means carried by said second support, said locking means slidably engagable with said locking element for locking said locking element and said locking means when said supports are in close proximity, thereby locking said members, said locking means and said locking element including means for unlocking said locking element and said locking means, said locking element including arm means for engaging said locking means to lock said members when said supports are in close proximity.

2. A locking device as in claim 1 wherein said locking means include key actuation for unlocking said members.

3. A locking device as in claim 1 wherein said locking means include plunger actuation for unlocking said members.

4. A locking device for locking sliding doors having bypassing first and second members where at least one of said members translates parallel to a plane of relative translation between said members, where said first member includes a first support, where said second member includes a second support, and where said supports are positioned in close proximity when said members are translated to a position for locking, comprising:

a locking element carried by said first support, locking means carried by said second support, said locking means slidably engagable with said locking element for locking said locking element and said locking means when said supports are in close proximity, thereby locking said members, said locking means and said locking element including means for unlocking said locking element and said locking means, said locking element including arm means having notches thereon whereby said notches engage said locking means to lock said members when said supports are in close proximity.

5. A locking device as in claim 4, wherein said arm means includes supporting means for enabling said first support to carry said arm means.

6. A locking device as in claim 5 wherein said supporting means includes a bracket wherein said bracket is carried by said first support.

7. A locking device as in claim 4 wherein said locking means includes a lock bolt for engaging said arm means to lock said members when said supports are in close proximity.

8. A locking device as in claim 7 wherein said locking means includes said lock bolt in a first position for engaging said arm means, means engaged with said lock bolt for translating said lock bolt to disengage said lock bolt from said arm means, and spring means to return said lock bolt to said first position when said locking means disengages from said arm means.

9. A locking device for locking a sliding door having bypassing first and second members where at least one of said members translates parallel to a plane of relative translation between said members, where said first member includes a first support, where said second member includes a second support, and where said supports are positioned in close proximity when said members are translated to a position for locking, comprising:

a locking element carried by said first support, locking means carried by said second support, said locking means slidably engagable with said locking element for locking said locking element and said locking means when said supports are in close proximity, thereby locking said members, said locking means including first unlocking means for unlocking said locking element and said locking means from one side of said door, said locking element including arm means having notches thereon whereby said notches engage said locking means to lock said members when said supports are in close proximity and wherein said locking means include a lock bolt for engaging said arm means to lock said members when said supports are in close proximity, said locking means including a locking cylinder, a first gear means carried coaxially by said locking cylinder, second gear means carried coaxially by an elongated arm, said second gear means disposed adjacent said first gear means to engage said first gear means, said elongated arm engagable with said lock bolt whereby rotation of said lock cylinder will engage or disengage said lock bolt from said arm means dependent upon rotation of said lock cylinder, said locking means further including second unlocking means engagable with said lock bolt for unlocking said locking means from said locking element from the other side of said door.

10. A locking device for locking a sliding door having bypassing first and second members where at least one of said members translates parallel to a plane of relative translation between said members, where said first member includes a first support, where said second member includes a second support, and where said supports are positioned in close proximity when said members are translated to a position for locking, comprising:

a locking element carried by said first support, locking means carried by said second support, said locking means slidably engagable with said locking element for locking said locking element and said locking means when said supports are in close proximity, thereby locking said members, said locking means including first unlocking means for unlocking said locking element and said locking means, said locking element including arm means having notches thereon whereby said notches engage said locking means to lock said members when said supports are in close proximity and wherein said locking means includes a lock bolt in a first position for engaging said arm means, said locki bolt having a portion thereon defining a cam surface, lock cylinder means engaging said lock bolt, including means for rotating said lock cylinder means, whereby rotation of said lock cylinder means will engage said cam surface to translate said lock bolt transversely to said cylinder means, thereby disengaging said lock bolt from said arm means, and spring means to return said lock bolt to said first position when said lock cylinder means disengages from said cam surface, said locking means further including second unlocking means engagable with said lock bolt for unlocking said unlocking means and said locking element from the other side of said door.

11. A locking device for locking sliding doors having bypassing first and second members where at least one of said members translates parallel to a plane between said members, where said first member includes a first support, where said second member includes a second support, and where said supports are positioned in close proximity when said members are translated to a position for locking, comprising:

a supporting structure, a locking arm having notches thereon carried by said supporting structure, said supporting structure carried by said first support, a padlock carried by said second support, said padlock slidably engagable with said locking arm, said padlock including a lock bolt for engaging said locking arm to lock said members when said supports are in close proximity, thereby locking said members, said padlock including means for unlocking said locking arm and said padlock for releasing said padlock from said locking arm and said locking arm including means for rotating said locking arm for disengaging said locking arm from said lock bolt when said locking arm is rotated thereby releasing said locking arm from said padlock.

12. A locking device as in claim 11 including said padlock having a shaft therein to accommodate said locking arm, the front portion of said shaft having chamfers thereon, said chamfers having a cross-sectional area larger than said locking arm to facilitate engagement of said padlock and said locking arm.

13. A locking device as in claim 11 including said locking arm having a beveled end to facilitate engagement of said locking arm and said padlock.

14. A locking device as in claim 11 including first arm means having first notches spaced by a distance y, second arm means having one or more second notches, first lock bolt for engaging first notches at first positions of relative translation of said members, second lock bolt for engaging said second notches at second positions of relative translation of the members, said second bolt positioned relative to said first bolt such that said second positions are displaced from said first position by some fractional multiple of y thereby permitting finer gradation of locking said locking means to said arm means.

15. A locking device as in claim 14 wherein said fractional multiple is $\frac{1}{2}$.

16. A locking device as in claim 14 including said second arm means spaced by a distance x and wherein x is equal to y.

17. A locking device as in claim 14 wherein said first position is equal to said second position.

18. In a locking device for locking sliding doors having bypassing first and second members where at least one of said members translates parallel to a plane of relative translation between said members, the improvement comprising:

said first member including a first support, said second member including a second support, said supports positioned in close proximity when said members are translated to a position for locking, a locking element carried by said first support parallel to said plane of relative translation, locking means carried by said second support, said locking means slidably engagable with said locking element for locking said locking element and said locking means when said supports are in close proximity, thereby locking said members, said locking means and said locking element including means for unlocking said locking element and said locking means, said locking element including arm means for engaging said locking means to lock said members when said supports are in close proximity.

19. A locking device for locking sliding doors having first and second members where at least one of said members translates, where said first member includes a first support, where said second member includes a second support, and where said supports are positioned in close proximity when said members are translated to a position for locking, comprising:

a locking element carried by said first support in the direction of translation of one of said members, locking means carried by said second support, said locking means slidably engagable with said locking element for locking said locking element and said locking means when said supports are in close proximity, thereby locking said members, said locking means and said locking element including means for unlocking said locking element and said locking means, said locking element including arm means for engaging said locking means to lock said members when said supports are in close proximity.

20. A locking device for locking sliding doors having bypassing first and second members where at least one of said members translates parallel to a plane of relative translation between said members, where said first member includes a first support, where said second member includes a second support and where said supports are positioned in close proximity when said members are translated to a position for locking, comprising:

a locking element mounted to said first support parallel to said plane of relative translation, and locking means mounted to said second support whereby said locking means engages said locking element when said supports are in close proximity, thereby locking said members, said locking means and said locking element including means for unlocking said locking element and said locking means, said locking element including arm means for engaging said locking means to lock said members when said supports are in close proximity.

21. A locking device for locking sliding doors having bypassing first and second members where at least one of said members translates parallel to a plane of relative translation between said members, where said first member includes a first support, where said second member includes a second support, and where said supports are positioned in close proximity when said members are translated to a position for locking, comprising:

locking means including a lock bolt carried by said second support, a locking element including arm means having notches therein for engaging said lock bolt carried by said second support, said locking means slidably engagable with said locking element for locking said locking element and said locking means when said supports are in close proximity, thereby locking said members, said locking means including means for releasing said locking means from said locking element, thereby unlocking said members, said locking element including means for rotating said arm means for releasing said locking element from said locking means, thereby unlocking said members.

22. A locking device as in claim 21 whereby said means for rotating said arm means includes a lock cylinder.

23. A locking device as in claim 22 wherein said lock cylinder carries coaxially a first gear means, said arm means carries coaxially a second gear means wherein said second gear means engages with said first gear means whereby rotation of said lock cylinder will engage or disengage said arm means from said lock bolt dependent upon rotation of said lock cylinder.

24. A locking device as in claim 23 including a second arm means carrying coaxially a third gear means, said third gear means engaging said first gear means, said locking means including a second lock bolt for engaging said second arm means, whereby rotation of said lock cylinder will engage or disengage said second arm means from said second lock bolt dependent upon rotation of said lock cylinder.

* * * * *